US010190391B2

(12) United States Patent
Antonsen et al.

(10) Patent No.: US 10,190,391 B2
(45) Date of Patent: Jan. 29, 2019

(54) VALVE, SYSTEM AND METHOD FOR COMPLETION, STIMULATION AND SUBSEQUENT RE-STIMULATION OF WELLS FOR HYDROCARBON PRODUCTION

(71) Applicant: TRICAN COMPLETION SOLUTIONS AS, Stavanger (NO)

(72) Inventors: Roger Antonsen, Houston, TX (US); Kristoffer Braekke, Stavanger (NO); Geir Lunde, Sandnes (NO)

(73) Assignee: TRICAN COMPLETION SOLUTIONS AS, Stavanger (NO)

( * ) Notice: Subject to any disclaimer, the term of this patent is extended or adjusted under 35 U.S.C. 154(b) by 262 days.

(21) Appl. No.: 14/427,081

(22) PCT Filed: Sep. 6, 2013

(86) PCT No.: PCT/NO2013/050151
§ 371 (c)(1),
(2) Date: Mar. 10, 2015

(87) PCT Pub. No.: WO2014/046547
PCT Pub. Date: Mar. 27, 2014

(65) Prior Publication Data

US 2015/0240595 A1 Aug. 27, 2015

Related U.S. Application Data

(60) Provisional application No. 61/704,056, filed on Sep. 21, 2012.

(30) Foreign Application Priority Data

Sep. 21, 2012 (NO) ..... 20121073

(51) Int. Cl.
*E21B 34/12* (2006.01)
*E21B 34/14* (2006.01)
(Continued)

(52) U.S. Cl.
CPC ..... *E21B 34/12* (2013.01); *E21B 34/14* (2013.01); *E21B 47/00* (2013.01); *E21B 43/14* (2013.01); *E21B 2034/007* (2013.01)

(58) Field of Classification Search
CPC ..... E21B 34/00; E21B 34/12; E21B 34/14; E21B 43/12; E21B 2034/007; E21B 47/00; E21B 43/14
See application file for complete search history.

(56) References Cited

U.S. PATENT DOCUMENTS 6,422,317 B1 7/2002 Williamson, Jr.
7,637,317 B1 * 12/2009 Hernandez ..... E21B 34/102 166/177.5

(Continued)

FOREIGN PATENT DOCUMENTS

| | | |
|---|---|---|
| NO | 20100211 | 8/2011 |
| NO | 20111679 | 6/2012 |
| WO | 2012/024773 | 3/2012 |

OTHER PUBLICATIONS

International Search Report dated Dec. 18, 2013 in corresponding International Application No. PCT/NO2013/050151.

(Continued)

*Primary Examiner* — Taras P Bemko
*Assistant Examiner* — Manuel C Portocarrero
(74) *Attorney, Agent, or Firm* — Wenderoth, Lind & Ponack, L.L.P.

(57) ABSTRACT

A valve for inclusion or insertion in a tubular includes a substantially cylindrical outer valve housing; an inner sliding sleeve mounted axially movable inside the valve hous- (Continued)

ing; and a seat arranged for receiving a drop ball, dart or falling device. The seat is built in such a way that it can partially or completely be removed or drilled out from the valve. The inner sliding sleeve includes a first profile arranged at a first end of the inner sliding sleeve and a second profile arranged at a second end of the inner sliding sleeve, wherein the first profile and the second profile are configured to be engaged with an activating or shifting tool inserted and run in the tubular after the seat has been partially or completely removed or drilled out from the valve in order to operate the valve from an open to a closed position and/or vice versa.

7 Claims, 5 Drawing Sheets

(51) Int. Cl.

| | |
|---|---|
| ***E21B 47/00*** | (2012.01) |
| ***E21B 43/14*** | (2006.01) |
| ***E21B 34/00*** | (2006.01) |

(56) References Cited

U.S. PATENT DOCUMENTS

| | | | | |
|---|---|---|---|---|
| 8,215,401 | B2 | 7/2012 | Braekke et al. | |
| 2007/0113639 | A1* | 5/2007 | DiFoggio | E21B 49/08 73/152.58 |
| 2010/0051291 | A1 | 3/2010 | Marcu | |
| 2011/0204273 | A1* | 8/2011 | Braekke | E21B 34/14 251/314 |
| 2011/0226489 | A1 | 9/2011 | Hofman et al. | |
| 2012/0160515 | A1 | 6/2012 | Braekke et al. | |
| 2012/0205121 | A1 | 8/2012 | Porter et al. | |
| 2013/0048298 | A1 | 2/2013 | Merron et al. | |

OTHER PUBLICATIONS

Norwegian Search Report dated Apr. 19, 2013 in corresponding Norwegian Application No. 20121073.

* cited by examiner

VALVE, SYSTEM AND METHOD FOR COMPLETION, STIMULATION AND SUBSEQUENT RE-STIMULATION OF WELLS FOR HYDROCARBON PRODUCTION

BACKGROUND

Field of the Invention

The present invention relates to a valve, system and method for completion, stimulation and subsequent re-stimulation of well(s) or borehole(s) for hydrocarbon production.

Related and Prior Art

The process of making a production well, after drilling it, ready for production and/or injection is called completion of a well. This principally involves preparing the bottom of the borehole at or in the proximity of the production layer(s) to the required specifications, running in the production tubing or pipe and its associated downhole tools, as well as perforating and stimulating, as required. The process of running in and cementing the casing can also be included, if necessary due to the strata structure. All these processes will be described in detail below.

A subterranean formation containing hydrocarbons consists of at least one layer of soft or fractured rock(s) or strata containing the hydrocarbons, in the following called a production layer. Each production layer must be covered by a layer of impermeable rock(s) or strata preventing the hydrocarbons from escaping. The production layers in an oil or gas field are collectively known as a reservoir.

The drilling can be done vertically through one or more strata/rock layers in order to reach the desired production layer(s), and then possibly horizontally along one or more strata to provide as efficient well(s) as possible. A production well extending through the reservoir is conventionally divided into production zones, and particularly one or more production zones per production layer. A production well may extend several thousand meters vertically through the formation, and be connected to substantially horizontal branches extending up to several kilometers through the production layer(s).

The drilling in the geological strata can be done by rotating a drill bit at the end of a drill string and forcing it in the desired direction through geological or rock layers or strata to create or form a wellbore. Once a predetermined length of the wellbore is drilled, the drill string with the drill bit may be pulled out, and the wellbore may be lined with a steel pipe called a casing or liner. Hence, an outer annular space is formed between the casing and the formation. It is a common, but not obligatory, practice to cement the casing to the formation by filling all or part of the outer annular space with cementing slurry or slurries. Open boreholes or wellbores are also common, when the strata allow having such. A fully or partially cemented casing can stabilize the formation, and at the same time can make it possible to isolate certain layers or regions behind the casing for retrieval of hydrocarbons, gas, water or even geothermal heat. It is well known to anyone skilled in the art that e.g. epoxy/resin-based cementing slurries in some cases are better suited for the task than cement based mixtures. The terms "cement" and "cementing" are thus to be construed generally as use or injection of a viscous slurry, which then hardens, for the purpose of retaining the casing in the formation and/or stabilizing the formation and/or creating a barrier between different zones, and not exclusively as use of cement only. Cementing tools or valves may be arranged in the casing at predetermined locations. When a segment of the casing is to be cemented, the cementing valve is opened and cement slurry is pumped down the casing, out through the valve-ports, and into the outer annular space between the casing and the formation. The person skilled in the art will be familiar with the use of suitable plugs, staged cementing, in which a first batch of cement or liquid slurry is allowed to set before the next batch of cement or liquid slurry is pumped into the outer annular space above it, thus reducing the hydro-static pressure from the cement, which might otherwise harm or damage a weak formation, and other cementing techniques and details.

During cementing, injection and production in wells as those described above, the possibility for large differential pressures between different zones increases with increasing depth(s). Production of hydrocarbons from strata deep below the seabed and geothermal applications are both likely to involve large or high pressures. Isolation of zones and injection of liquid or gas to increase the pressure in the production zones or regions can lead to correspondingly large differential pressures.

When a well is drilled and lined with a casing, a return flow path from the formation around the casing to the surface must be established. In some instances, it is possible to penetrate the casing by setting off explosive charges at one or more predetermined depths to enable radial flow of production fluid from the formation into the casing. In other instances, the casing may be provided with prefabricated holes or slits, possibly combined with sand screens. In many applications, the combination of high hydraulic pressure and relatively porous production strata implies a substantial risk for damage of the formation if explosives are used to penetrate the casing. In these cases, it is a common practice to use valve sections with radially extending openings which are opened to allow radial flow of cement or epoxy/resin out of the casing for stabilizing and retaining the casing in the formation, for radial flow of injection fluid from inside the pipe to the surrounding formation to maintain or increase the hydraulic pressure in the formation, and/or for radial flow of production fluid from the formation into the casing. Such valve sections designed for inclusion in a tubular, usually by means of threaded couplings of the same kind as used when connecting the pipe segments to a string, are called "valves" in the following for simplicity.

Hydraulic fracturing, poses particularly demanding requirements to the design, robustness and durability of the valve(s). In hydraulic fracturing, a mixture containing e.g. 4% small ceramic particles can be injected into the formation at a pressure quite above the formation pressure. Fractures in the formation are expanded by the pressure and filled with these particles. When the hydraulic pressure is removed, the particles remain in the fractures and keep them open. The purpose is to improve the inflow of production fluid from the formation.

It is also a common practice to insert at least one production pipe into the casing. The inner annular space between the casing and the production pipe is filled with a suitable liquid/fluid or mud, and is generally used to maintain and increase hydraulic pressure. The production pipe is in these cases used as the return path, and conveys the production fluid up to the surface. When using a production pipe within the casing, it is of course also necessary to provide the production pipe with openings or apertures for production fluid, and it may be necessary to isolate production zones from the liquid/fluid or mud in the inner annular space between the production pipe(s) and the casing. Isolating the different zones can be accomplished by using mechanical plugs called "packers", rather than by using cementing slurry or slurries. Such packers are mainly used in the inner annular space between the production pipe and the casing, because it may be problematic to achieve sufficient sealing against the formation, especially if the formation is porous. Valves corresponding to the valves described above can be arranged in the production pipe(s), and they can be opened once they are localized in the production zone(s).

One or more injection wells may be provided at a distance from the production well(s) in a field. The injection well(s) can be used to pump water, saline or gas back into the formation in order to increase the pressure. Additives such as acid, solvents or surfactants may be added to the fluid in order to enhance production of hydrocarbons in processes known as "stimulating a zone".

Valves can be used to control the flow of formation fluid from a production zone into the production pipe through the casing, possibly through a horizontal and/or vertical branch. Valves can also be used for controlling an injection fluid from an injection well into a certain zone of the formation to be stimulated. When the formation fluid from a production zone contains too much water to be economically sustainable, the production zone can be shut down, typically by means of one or more valves. The valves are operated between open and closed, and possibly choked, positions using a variety of techniques, including use of wireline tools, strings of pipes, coiled tubing, self-propagating tools known as borehole or well tractors or runners, and drop balls. Some valves may be operated using separate hydraulic control lines. However, the space and cost required for providing separate hydraulic control lines and relatively expensive hydraulic valves quickly make hydraulically operated valves impractical for use in a tubular with many valves.

Hence, it is an object of the present invention to provide a tubular or a pipeline with a large number of valves, while avoiding expensive valves, hydraulic control lines and/or unnecessary loss of expensive production time, etc.

SUMMARY OF THE INVENTION

The valve, system and method according to the present invention will permit completion of well(s) for production of hydrocarbons by use or means of (sliding) valves, in which well(s) a drop ball may operate said multiple valves during initial activation. This is very time saving and effective and enables operator(s) to get the first oil produced earlier.

The valve, system and method according to the present invention will further allow making, at a later time, both water cut(s) and repeated stimulation(s) of the well(s), if necessary, by drilling out the ball seats of the (sliding) valves and using thereafter different suitable mechanical tools in order to operate the valves.

The main features of this invention are given in the independent claims. Additional features of the present invention are given in the dependent claims.

BRIEF DESCRIPTION OF THE DRAWINGS

The invention will be described in greater detail in the following with reference to the accompanying drawings in which similar numerals refer to similar parts, and where.

DETAILED DESCRIPTION OF A PREFERRED EMBODIMENT

Figure 1:
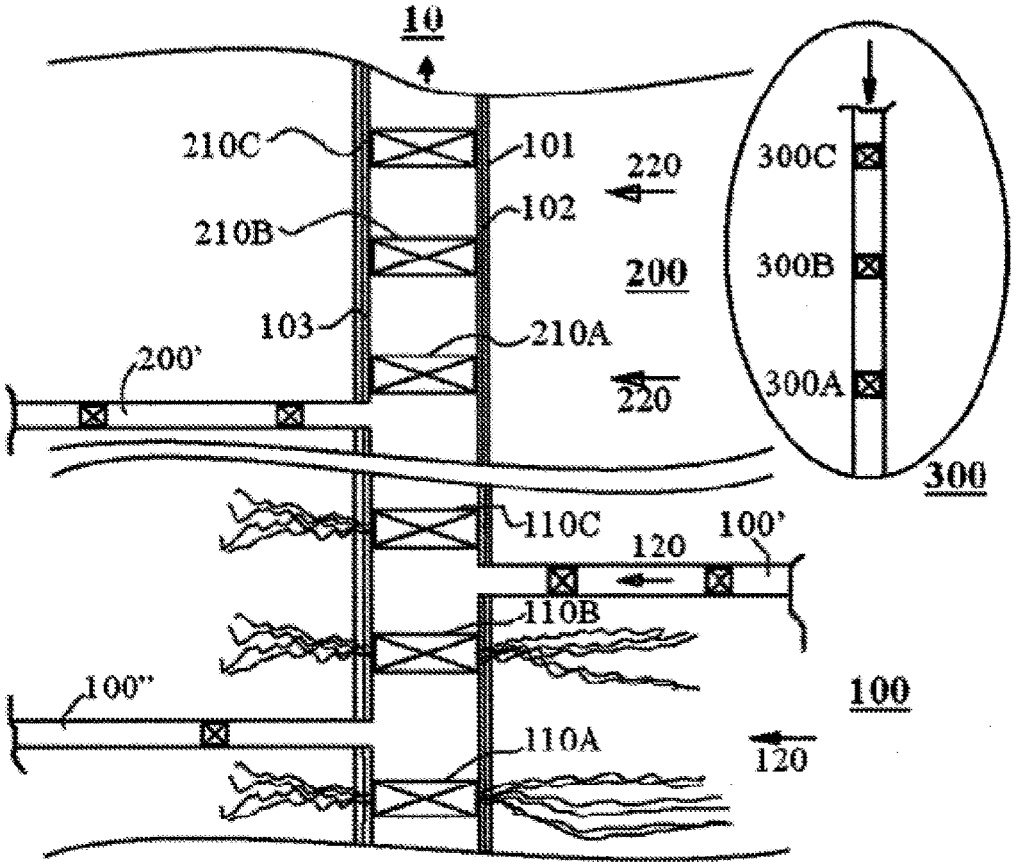
FIG. 1 is a schematic view of a well comprising several zones and branches.

FIG. 1 is a schematic cross sectional view of a well system used in production of hydrocarbons, i.e. oil and/or gas, from a subterranean reservoir. A borehole or wellbore 101 is drilled through several layers of rock(s) or strata in the formation. In FIG. 1, two production layers or zones 100 and 200 are shown. The wellbore is lined with a steel casing 102, which can be cemented to the formation. Open boreholes or wellbores can also be possible. In FIG. 1, the production layers 100 and 200 contain hydrocarbons, and they are separated by rock layers that do not contain hydrocarbons. The casing 102 may be penetrated at depths corresponding to the productive layers 100 and 200, and hydraulic fracturing may be used in order to create and open cracks in the formation for facilitating fluid flow from the formation into the production well. Horizontal well(s) 100', 100" and 200' may branch out from a vertical production well, and extend several kilometers through production layer(s) 100, 200 containing hydrocarbons.

A production pipe 103 is provided within the casing 102, and the completed production well can be divided into several production zones by using packers (not shown) in order to seal off the annular space formed by the outer surface of the production pipe 103 and the inner surface of the casing 102. Valves 110A-110C, 210A-210C, . . . shown in FIG. 1 are disposed with predetermined distance(s) along the axial length of the production pipe 103 and can control the fluid flow from the formation 100, 200 into the segment of production pipe corresponding to the production zone. The valves can generally be of different design or types, e.g. sliding sleeve valves, butterfly valves and ball valves of different sizes and designs, and used for different purposes as known in the art. In operation, the fluid flowing from several zones (shown by arrows 120, 220) at different rates can be mixed and conveyed up the production pipe to the surface 10.

In order to increase the amount and/or rate at which hydrocarbons are produced from a zone, one or more injection wells 300 may be provided at a certain distance from the production well 101-103. The injection well 300 injects fluid into one or more zones, e.g. to increase the pressure in the reservoir 100, 200 or to provide some chemical composition(s), and can be made in a similar manner as the production well. A typical oil or gas field can comprise one or more production wells and zero or more injection wells.

As discussed above, various devices, like sliding sleeve valves/sliding valves, butterfly valves and ball valves of different sizes and designs, can be used to control the fluid flow and for other purposes. For convenience, the term "ball operated device" is intended to include these and other devices when hydraulically operated using a drop ball, dart or similar (falling) device. All such ball operated devices comprises a seat on which the ball, dart or similar device can land. The ball seat can be a cage- or tubular- or circular-shaped element displaced within a valve arrangement or sleeve and with a ring-shaped lug having a diameter less than the diameter of the ball, dart or similar device that is to land thereon. Obviously, drop balls of different sizes may be provided as in a conventional drop ball system. The difference is that a drop ball will pass groups of seats having similar sizes until it operates a group of valves rather than just one single device passed and operated on by conventional drop ball systems.

Figure 2A:
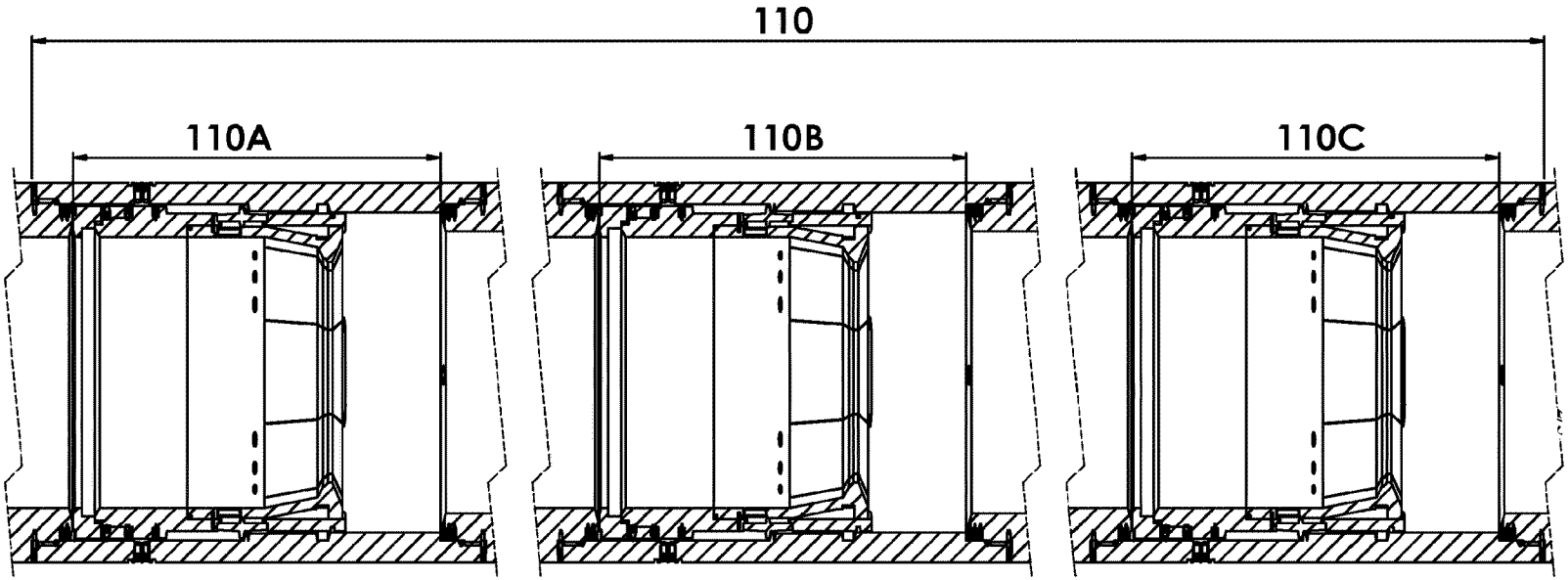
FIG. 2A-2B show schematic views of a valve system according to one embodiment of the invention in a closed, respectively open, position.
Figure 2B:
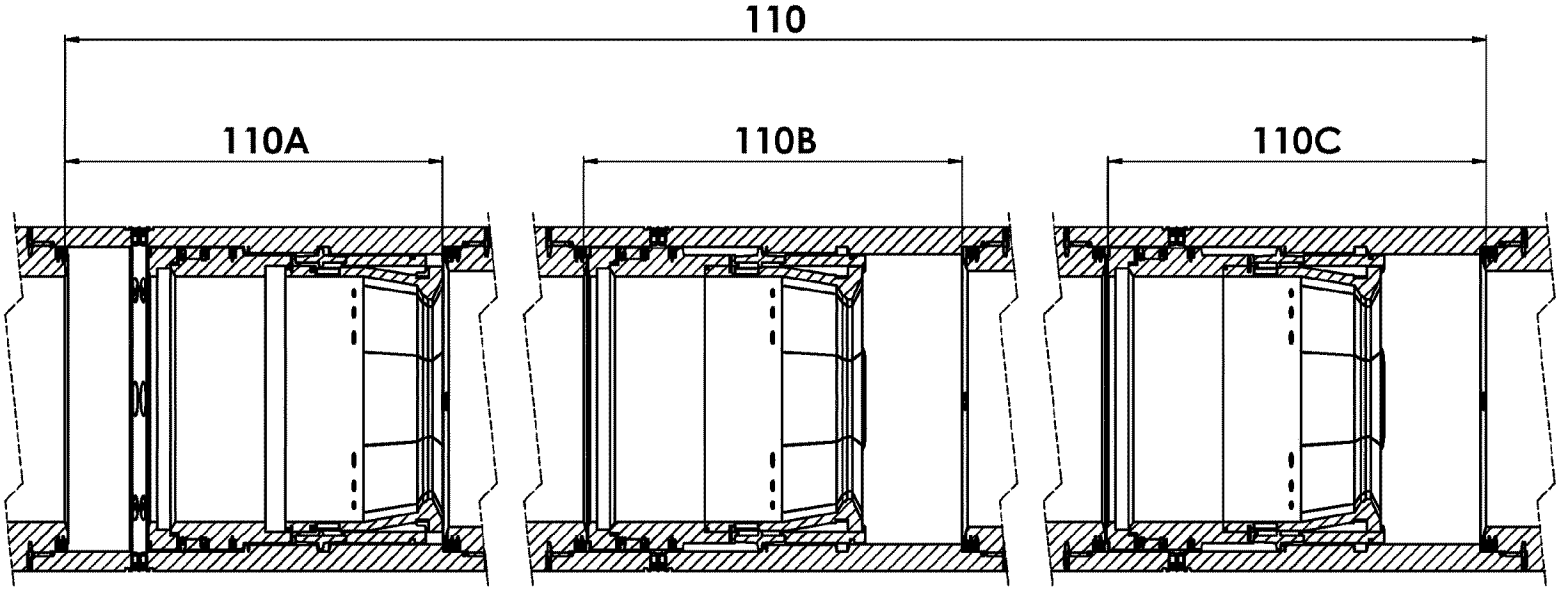

FIG. 2A-2B show a tubular 110 which can be a part of the production pipe 103 and with at least one group of at least two valves 110A-110C, all of which are disposed within the tubular 110 along the axial length thereof and with predetermined distance(s) from each other and can be provided with a ball seat, for example an expandable ball seat, e.g. as disclosed in NO 20100211 and U.S. Ser. No. 12/705,428 "Expandable ball seat" both being assigned to i-Tec AS and herein incorporated by reference in its entirety, and thus can be opened one after the other using one and only one drop ball. The valve 110A is closest to the surface, and hence opened first by e.g. the drop ball. In FIG. 2A the valve 110A is shown in a closed position, while in FIG. 2B the valve 110A is shown in an open position.

Figure 3A:
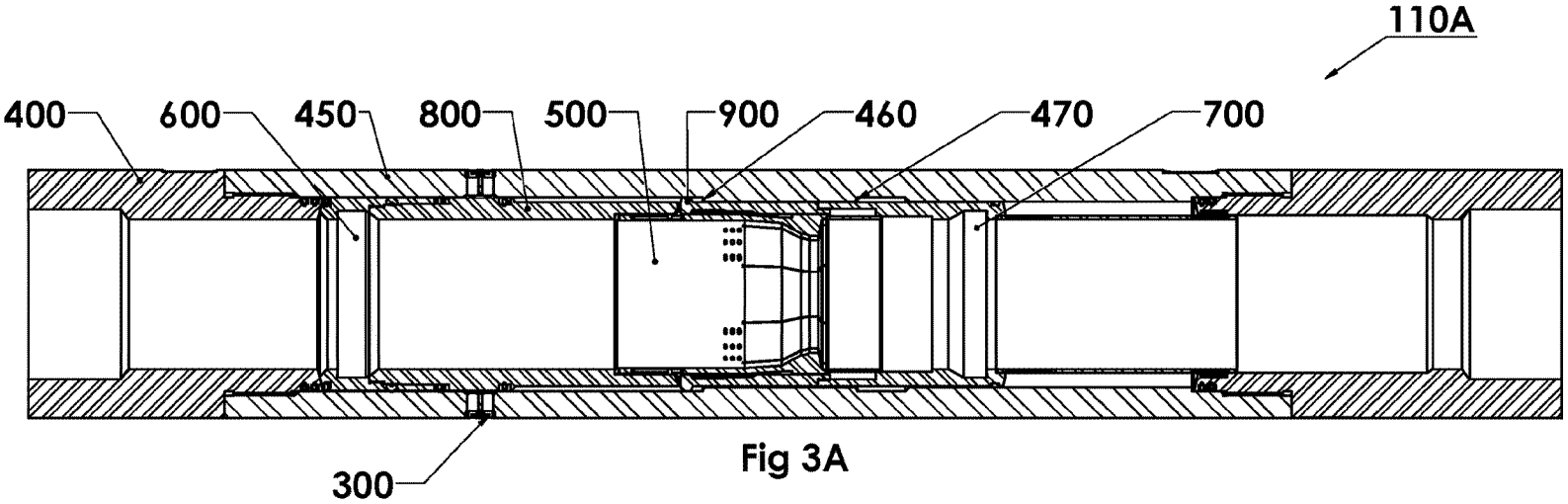
FIG. 3A-3B show schematic views of a valve according to one embodiment of the invention in a closed, respectively open, position.
Figure 3B:
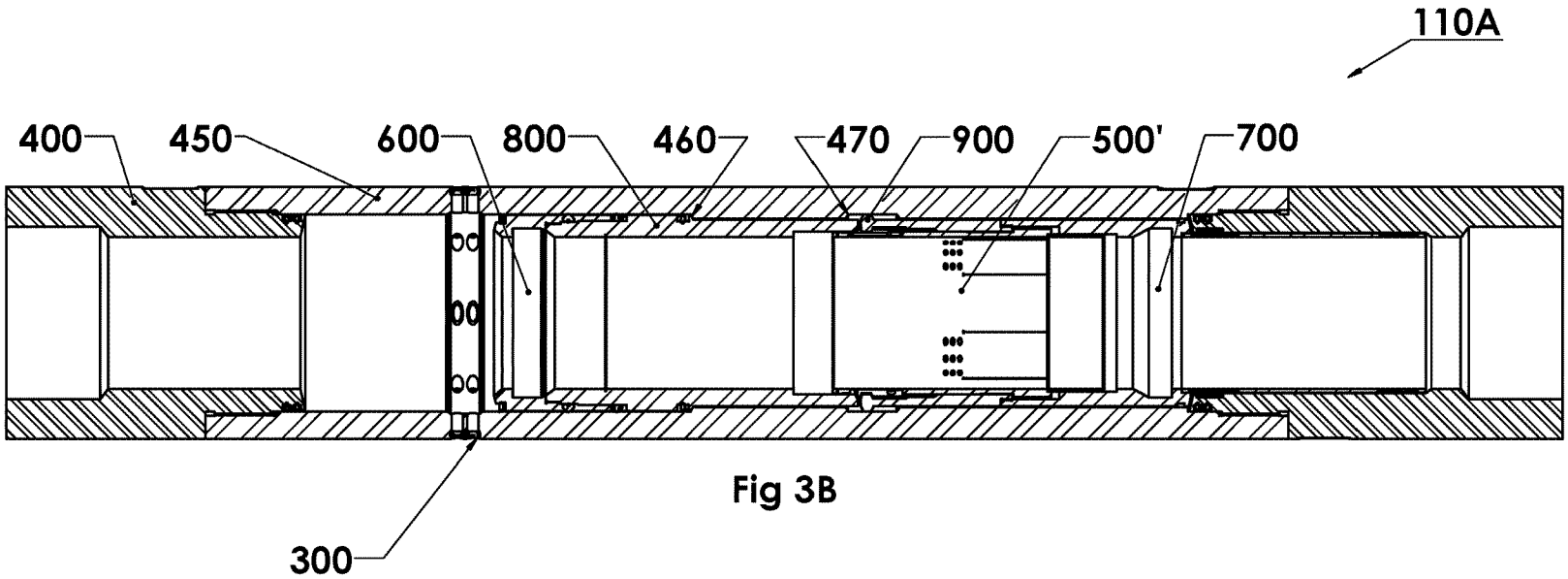

FIG. 3A-3B show schematic longitudinal cross-sectional views of a valve according to one embodiment of the present invention in a closed (FIG. 3A), respectively open (FIG. 3B), position.

The present invention provides a valve 110A for inclusion or insertion in a tubular, comprising a substantially cylindrical outer valve housing or outer sleeve 450 having radially extending side ports 300 and a substantially cylindrical inner sliding sleeve 800 mounted axially movable inside the valve housing or outer sleeve 450. A substantially cylindrical end part or portion 400 can be (firmly) connected to the valve 110A housing or outer sleeve 450 in order to form an outer shell 400, 450 of the valve 110A. As mentioned, the inner sliding sleeve 800 can be moved axially inside the valve housing or outer sleeve 450 in order to open or close the radial side ports 300. The sliding sleeve 800 has no ports, and the top or upper edge of the sleeve 800 can be moved past the housing ports 300 in order to reach the open position. The inner sliding sleeve 800 can further comprise a seat or ball seat 500, e.g. an expandable ball seat as described in NO 20100211 and U.S. Ser. No. 12/705,428 "Expandable ball seat" both being assigned to i-Tec AS and herein incorporated by reference in its entirety. The seat 500 can be operated by a drop ball (not shown) landing thereon, so that the valve 110A could be opened.

Since the sliding sleeve 800 has no ports, a simpler design is achieved. In particular, the cost of adding hard insets in the ports is reduced.

The inner sliding sleeve 800 can also be rotationally locked or prevented from rotating in the valve housing 450, because it may become necessary to rotate an activating, shifting, drilling or other mechanical tool (not shown), if necessary.

The near or top or upper side or end or edge of the valve 110A or inner sleeve 800 can be defined as the valve 110A or inner sleeve 800 end being closer to surface, than the other valve 110A or inner sleeve 800 end, which is being defined as the far or bottom or lower side or end or edge of said valve 110A or inner sleeve 800.

The first time the hydrocarbon layer 100 will be stimulated (with e.g. sand or ceramic particles "fraccing" and/or acid injecting), a plurality of drop balls with increasing diameters can be used in order to open each group of valves in a number of zones 100, 200, wherein the lowest zone 100 is being opened first and so on upwards, as it is described in NO 20111679 and NO 20100211 both being assigned to i-Tec AS and herein incorporated by reference in its entirety.

After this operation is done and either immediately or at a later time, the ball seat 500 in each inner sleeve 800 or valve 110A and the used drop ball(s) can be removed e.g. by drilling them out, so that the valve 110A and the rest of the seat 500' will be as shown in FIG. 3B. The material of the ball seat 500 should carefully chosen, so that it would be "hard" enough in order not to break and be able to hold the drop ball, dart or similar (falling) device that has landed thereon for at least a certain period of time, but at the same time this material should be "soft" enough in order to substantially ease the removing or drilling-out process.

The inner sliding sleeve 800 of the valve 110A comprises further a first or upper grooved or recessed profile 600 arranged or formed on its inner wall and in the proximity of its upper or top end and a second or lower grooved or recessed profile 700 arranged or formed on its inner wall and the proximity of in its lower or far end in order to operate the valve 110A with the help of an activating or shifting tool inserted and run in the tubular after the ball seat 500' is removed or drilled out (FIG. 3B).

As the seat 500' is removed or drilled out, there will not be any constrictions or narrowings or restrictions or area reductions in the well or tubular. As mentioned above it will therefore be possible to enter into the well or tubular with different mechanical tools (e.g. coiled tubing or pipe, activating or shifting tool, opening-closing tool, etc.), which can cooperate/connect with or grab the first or upper profile 600 in order to pull or push the valve 100A sliding sleeve 800 to its closed position when necessary, e.g. if certain zone(s) produce only water.

This (the drawing of the sliding sleeve 800 to the closed position) can also be done with all valves in order to prepare the production well to re-stimulation. This can be done by opening, after production shut down or closing of all valves, a certain number of valves that are to be stimulated (typically those valve that are in a certain zone), wherein an inserted mechanical tool or device can cooperate/connect with or grab the lower or far profile 700 of the sliding sleeve 800 in order to push or pull the respective valve(s) open. When the stimulation is done or completed, the upper or top or near profile 600 of the sliding sleeve 800 can once again be pulled or pushed by said mechanical tool or device in order to close the respective valve(s). This operation or process can be repeated for other valves/zones. When all re-stimulation operations are completed or finished, all the valves can then be re-opened in order to start again the hydrocarbon production. This re-stimulation operation or process can be repeated at a later time, if needed or desired.

The inner wall of the valve 110A housing 450 and/or the outer wall of the sliding sleeve 800 can comprise or have arranged thereto at least one means 460, 470, 900, e.g. shoulder(s) e.g. 460, 470 formed on the inner wall of the housing 450 and/or a latch ring 900 arranged in a recess formed on the outer wall of the sliding sleeve 800, for keeping or retaining the valve 110A in an open or a closed position. Hence, said at least one means for position retaining prevents the sliding sleeve 800 from being swept along by the fluid flowing in the central bore, and thus from being opened or closed unintentionally.

Some or all of the side ports 300 in the valve 110A can be designed with different diameters for different purposes with respect to other side ports within the same valve and/or the side ports in other valve(s) in the valve group 1108, 110C or the valve system 210A-210C.

The side ports 300 can be manufactured from a material, e.g. tungsten carbide (WC), that is (much) harder than the material of the valve 110A housing 450, such that the valve 110A will withstand the wear from the ceramic balls used in hydraulic fracturing.

The inner surfaces of the valve 110A or housing 450 may also be hardened.

The inner and/or outer surface(s) of the valve 110A housing 450 and/or the sliding sleeve 800 can be coated with at least one non-stick coating layer, thus preventing e.g. cement from bonding to the valve components and allowing it to be used as a part of a cemented liner.

Magnets, e.g. permanent magnets, or other suitable means (not shown) in the valve 110A can indicate if the valve 110A is in an open or a closed position.

Thus, the present invention provides a simple, robust, durable cylindrical valve, valve system and method for completion, stimulation and subsequent re-stimulation of well(s) for hydrocarbon production.

The invention according to the accompanying claims and described in detail above, thereby solves a number of the problems and/or disadvantages of the prior art.

Additional modifications, alterations and adaptations of the present invention will suggest themselves to those skilled in the art without departing from the scope of the invention as expressed and stated in the following patent claims.

The invention claimed is:

1. A valve for inclusion or insertion in a tubular, the valve comprising:

a substantially cylindrical outer valve housing having radially extending side ports;

an inner sliding sleeve mounted axially movable inside the valve housing; and a seat arranged for receiving a drop ball, dart or falling device for operating the valve, wherein the seat is built in such a way that it can partially or completely be removed or drilled out from the valve by a drilling tool providing for restrictionless passage through the valve, wherein the inner sliding sleeve further comprises a first or upper profile arranged at a first or upper end of the inner sliding sleeve and a second or lower profile arranged at a second or lower end of the inner sliding sleeve, wherein the first or upper profile of the inner sliding sleeve and the second or lower profile of the inner sliding sleeve are configured to be engaged with an activating or shifting tool inserted and run in the tubular after the seat has been partially or completely removed or drilled out from the valve in order to operate the valve from an open to a closed position and/or vice versa, wherein an inner wall of the valve housing comprises a first shoulder configured to retain the valve in an open position, wherein the inner wall of the valve housing comprises a second shoulder configured to retain the valve in a closed position, wherein the first or upper profile of the inner sliding sleeve is configured to be pulled or pushed by the activating or shifting tool in order to operate the valve from an open to a closed position, after the seat has been partially or completely removed or drilled out from the valve, and wherein the second or lower profile of the inner sliding sleeve is configured to be pulled or pushed by the activating or shifting tool in order to operate the valve from a closed to an open position, after the seat has been partially or completely removed or drilled out from the valve.

2. The valve according to claim 1, further comprising means for indicating whether the valve is in an open or a closed position.

3. The valve according to claim 1, wherein the side ports are manufactured from a material that is harder than a material of the valve housing and that can withstand wear during hydraulic fracturing.

4. The according to claim 1, wherein inner and/or outer surface(s) of the valve housing and/or sliding sleeve are coated with at least one non-stick coating layer.

5. A valve system for completion, stimulation and subsequent re-stimulation of at least one well for hydrocarbon production, the valve system comprising at least one valve group comprising a certain or predetermined number of valves arranged with a predetermined distance from each other, wherein at least one valve from said at least one valve group is the valve according to claim 1.

6. A method for completion, stimulation and subsequent re-stimulation of at least one well for hydrocarbon production, the method comprising:

inserting at least one valve in a tubular in order to provide at least one group of valves in a valve system in at least one hydrocarbon production well, wherein the at least one valve comprises a substantially cylindrical outer valve housing having radially extending side ports, an inner sliding sleeve being mounted axially movable inside the valve housing, and a seat being arranged for receiving a drop ball, dart or falling device for operating the valve, and wherein an inner wall of the valve housing comprises a first shoulder configured to retain the valve in an open position, and the inner wall of the valve housing comprises a second shoulder configured to retain the valve in a closed position;

opening some or all of the valves in at least one valve group of the valve system arranged in a number of zones by at least one drop ball, dart or falling device and in cooperation with the valve seat of each valve that is to be opened, wherein the valve group for a lowest zone is opened first;

removing or drilling out partially or completely the seat from the valve by a drilling tool, thus providing for restrictionless passage through the valve;

inserting and running, in the tubular, an activating or shifting tool; and operating some or all of the valves in the at least one valve group of the valve system with the use of the activating or shifting tool and in cooperation with a first or upper profile arranged in proximity of a first or upper end of the inner sliding sleeve of the valve and a second or lower profile arranged in proximity of a second or lower end of the inner sliding sleeve of the valve, wherein the activating or shifting tool pulls or pushes the first or upper profile in order to operate the valve from an open to a closed position and/or pulls or pushes the second or lower profile in order to operate the valve from a closed to an open position, after the seat has been partially or completely removed or drilled out from the valve.

7. The method according to claim 6, wherein said inserting and running step and/or said operating step is/are repeated.

* * * * *